United States Patent [19]

Larson

[11] 4,077,109

[45] Mar. 7, 1978

[54] HOT WORKING OF METAL POWDERS

[75] Inventor: Jay Michael Larson, Warwick, N.Y.

[73] Assignee: The International Nickel Company, Inc., New York, N.Y.

[21] Appl. No.: 684,479

[22] Filed: May 10, 1976

[51] Int. Cl.[2] ..... B22F 3/24

[52] U.S. Cl. ..... 29/420; 264/111; 29/421 R; 29/DIG. 31

[58] Field of Search ..... 75/223, 214, 226; 29/420, 421, 420.5; 264/111, 121

[56] References Cited

U.S. PATENT DOCUMENTS

| | | | |
|---|---|---|---|
| 2,725,288 | 11/1955 | Dodds et al. | 75/226 |
| 3,741,755 | 6/1973 | Allen | 29/420 |
| 3,807,009 | 4/1974 | Östbo | 29/421 R |
| 3,895,436 | 7/1975 | Summers et al. | 29/421 R |

*Primary Examiner*—E. M. Combs
*Assistant Examiner*—V. K. Rising
*Attorney, Agent, or Firm*—George N. Ziegler; Ewan C. MacQueen

[57] ABSTRACT

Metal powders are hot isostatically pressed in a can or container produced from superplastic metal sheet.

4 Claims, 4 Drawing Figures

HOT WORKING OF METAL POWDERS

Figure 1:
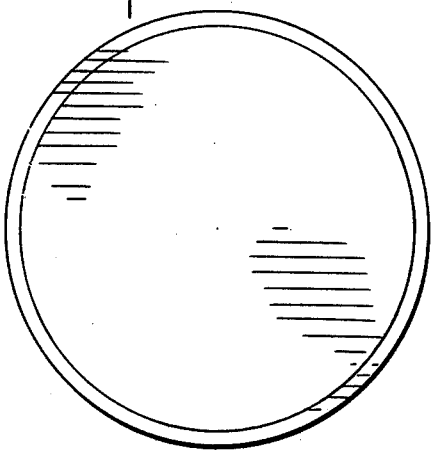

The present invention is directed to an improvement in the hot isostatic pressing of metal powders to form consolidated metal shapes and more particularly to an improvement in the metal can or container to be used in such a process.

The production of consolidated metal articles from metal powders is now at a well-advanced state. It has long been considered that consolidated metal articles could be produced from metal powders by packing metal powders into an appropriate container and then converting the assembly into a consolidated article by heating and working, for example, extrusion, or by some other means. More recently, the economic benefits conferred by the conversion of canned metal powders into consolidated shapes at or close to the desired final shape of the part has come to the fore. For example, in the production of precision parts such as rotors for gas turbines and the like, the excessive costs encountered in machining a forged blank to final dimension have become more and more critical. Improved devices for producing parts by hot isostatic pressing of metal powders using a highly pressurized fluid such as argon gas at elevated pressing temperature to provide a part which could be converted into a usable article with little or no final machining have become available. Improved design and construction of equipment for conducting hot isostatic pressing (HIPping) has now made the process one of considerable commercial importance and has pointed the need for appropriate solution of various other metallurgical problems coincident with the use of such equipment. One of the auxiliary pieces of equipment to be provided in connection with hot isostatic pressing is the can or container used to hold and shape the powders during the course of the hot isostatic pressing itself. Obviously, the metal employed to produce the can or container for use in the HIPping process must be compatible in terms of melting point with the composition of the materials being converted from powder into final pressed objects. Furthermore, the can material should itself be capable of ready removal from the final HIPped article by acid leaching, by machining, or by some other relatively inexpensive means. Furthermore, the can must itself be devoid of leaks since it is subjected in use to the effects of a fluid at high temperature and pressure. For example, pressures employed in the HIPping process may vary over a working range of 1,000 pounds per square inch (psi), up to 30,000 pounds per square inch, or even higher, and temperatures employed in forming parts from nickel-base, iron-base and cobalt-base metal powders vary over the range from about 1400° to about 2600° F. In addition the metal material employed to provide the can or container must be readily capable of being formed to precise dimension and/or complex shape.

The present invention is based on the discovery that superplastic iron-base or nickel-base materials may be employed with great advantage in the preparation of metal cans or containers for use in the HIPping process as applied to the provision of HIPped articles made of metal of relatively high melting point and including the high temperature corrosion resistant metal "superalloys" employed in applications such as gas turbine rotors and the like.

Generally, the process of the invention is directed to a method for the hot isostatic pressing of metal powders contained in a metal can wherein the metal can or container for use in the hot isostatic pressing of metal powders is prepared by welding together elements of superplastic metal sheet having sufficient thickness of metal to form the desired metal can, placing the resulting weldment within a mold or die having the desired can contour, inflating the weldment within said mold using low internal pressure at a superplastic forming temperature for said superplastic metal while preventing substantial movement of said superplastic metal in the region of the weld, thereafter removing said can from said mold, filling said can with metal powder to be hot isostatically pressed and subjecting the assembly to a combination of elevated temperature and fluid pressure sufficient to hot press said metal powder.

In initially forming the desired weldment from which the can is to be formed under low internal fluid pressure, it is sufficient merely to employ flat segments of sheet having dimension sufficiently great to completely cover the openings represented by the parting faces of the hot forming die. The sheet segments can be welded together about the periphery thereof by autogenous or filler wire welding. Advantageously, one of the sheet segments to form the can or container to be formed includes a tube welded thereto and communicating through the interior thereof to the space between the two superplastic metal sheets. The desired fluid forming pressure can be communicated through the aforementioned tube to the interior of the can material during forming. It is to be understood that superplastic forming requires sufficient time at temperature for the can components to be extended under the forming pressure so as to confirm to the surface of the die. The temperature and forming pressure employed will be compatible with the superplastic metal. Generally, forming temperatures in the range of about 1600° to about 1900° F. and forming pressures in the area of about 10 to about 250 pounds per square inch may be employed. Superplastic metals which may be employed in providing the can include a superplastic stainless steel containing about 18 to 35% chromium and about 2 to about 12% nickel as described in U.S. Pat. No. 3,574,002, superplastic nickel-chromium-iron alloys containing about 19 to about 60.5% nickel and 24.5 to 43.1% chromium as described in U.S. Pat. No. 3,519,419, and a superplastic alloy steel containing nominally 4% nickel, 3% molybdenum and 1.6% titanium as described by Smith & Ridley in a paper entitled "Design of A Superplastic Alloy Steel", Metals Technology, April, 1974, at pages 191 to 198. As is known in the art, steels and alloys in the superplastic condition are characterized by a fine grain structure not exceeding about 5 microns or 10 microns in average size. Die materials which may be employed in forming the can include various hot die steels, stainless steels, ceramics, graphite, etc. The die materials employed should of course be capable of rendering service for sufficient length of time at the temperature regime employed in superplastic forming. The dies in appropriate instances can be produced as castings.

The initial weldment can be produced merely by peripherally welding together flat sheet portions of appropriate dimension. However, if desired, the can segments can be partially formed as by deep drawing so as to provide can segment having formed edges mating in the same plane, whereafter the edges may then be welded together autogenously or by other means. In the superplastic forming operation it is important that the amount of deformation of metal in the weld region be restricted. Thus, in the case of flat disk portions autogenously welded around the periphery, the initial weldment is made such that its major dimension exceeds the major dimensions of the opening in each die face by a small amount, e.g., at least about 0.1 inches so that, upon closing of the die parts thereupon, restraint will be placed upon deformation of metal in the region of the weld during the superplastic forming operation. It is to be appreciated that the weld region itself will have a cast structure and will not be superplastic. Similarly, metal in the weld heat-affected zone will likely be grain-coarsened and not superplastic. Accordingly, the angular rotation of the superplastic sheet segments during forming about the center of the weld as a rotational axis should be limited so as not to exceed more than about 90°. Preferably, the angular rotation of the sheet segments about the center of the weld does not exceed about 45°, and with thin sheet stock, e.g., 0.020 inches should not exceed 0°. By proceeding as aforementioned, stresses in the area of the weld likely to cause failure of the weld during the superplastic forming operation will be maintained within acceptable limits and the production of fractures in or near the weld area will be avoided. This step is very important since during subsequent hot isostatic pressing operations any fractures in the weld will be penetrated by the high pressure forming fluid. It is also to be appreciated that the tensile elongation at superplastic forming temperatures for the superplastic materials contemplated herein will be at least 150% and in many instances will be 1000% or even more. Accordingly, as long as sufficient time is provided for the superplastic forming operation the superplastic material will extend so as to conform to the forming mold cavity. The concomitant thinning of the wall of the can during forming can be calculated beforehand and the appropriate metal thickness provided in the initial can-forming material. It is also to be appreciated that, in instances wherein re-entrant angles are desired in the formed can for impression in the final hot isostatically pressed object, appropriate superplastic forming mold design through the use of multi-part molds can be afforded. It is also to be appreciated that the can or container can be formed superplastically in a wide variety of shapes of differing design which can be provided in the superplastic forming mold. The superplastic metal will conform to the surface of the forming mold provided sufficient time, temperature and forming pressure are employed. In this way, great flexibility in design of the can is afforded. In order to minimize forming time it is desirable to pre-heat the molds to the superplastic forming temperature beforehand.

The forming tube or umbilicus initially attached to one sheet portion intended to form the can also provides a useful means for filling the can after formation and for evacuating the powder after the can is filled. The umbilicus can be sealed off by welding prior to hot isostatic pressing of the powder-filled can. Some examples will now be given.

EXAMPLE I

Figure 2:
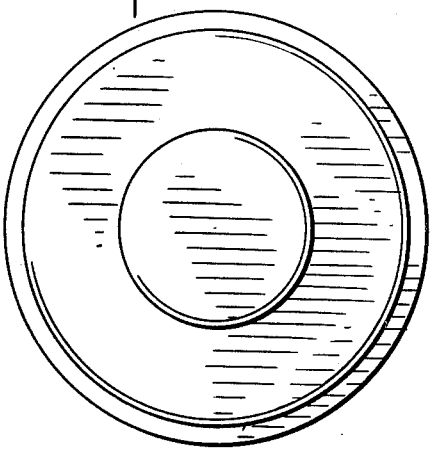
Figure 3:
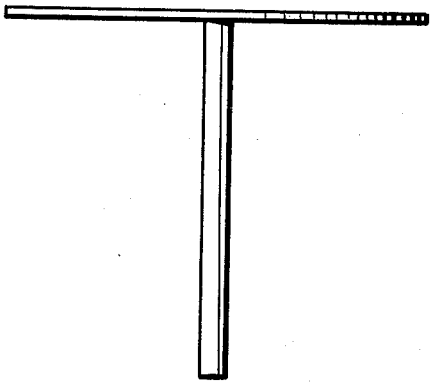
Figure 4:
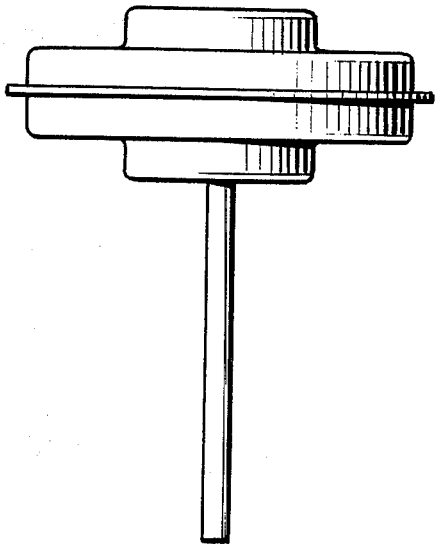

A two-part mold containing the contour of a turbine rotor disc with the parting line corresponding to the major or transverse periphery of the disc was prepared from a cast stainless steel. The faces of the mold parts including a circular opening about 6¾ inches in diameter. One mold was provided with a central hole, 9/16 inch in diameter. Two discs of a superplastic stainless steel containing nominally 26% chromium and 6% nickel, 0.060 inches thick and having a grain size not exceeding about 5 microns were prepared. The discs were about ¼ inch to 1 inch in diameter larger than the mold cavity openings. One disc was center drilled so that a pressure tube could be attached. A pressurizing and evacuation tube consisting of a ½ inch mild steel or stainless steel pipe was autogenously welded to the center hole of the aforementioned center drilled disc after which the two discs were edge welded autogenously. The welded assembly is shown in plan and side views respectively in FIGS. 1 and 3 of the drawing. The pressurizing-evacuation tube was placed through the center hole of the mold bearing the same and the mold was assembled by bolting. The outer edge of the superplastic bag material was clamped between the molds to substantially prevent deformation of the weld area during forming. The assembly was then placed in a furnace at 1800° F. and heated for one hour. The superplastic can material was then inflated using 100 pounds per square inch of argon or nitrogen for one hour. During this time, the can material deformed superplastically and it conformed to the surfaces of the forming mold. After superplastic forming, the assembly was removed from the furnace and the inflated can was removed. Thickness measurements on the completed can showed that thinning to as little as 0.019 inches had occurred at some points. The formed can is shown in plan and side views, respectively in FIGS. 2 and 4 of the drawing. The can was then filled with a superalloy (IN-792) powder containing Ni base, 12.7% Cr, 9% Co, 2.0% Mo, 3.9% W, 3.9% Ta, 4.0% Ti, 4.0% Al, .03% C, which had been thermoplastically processed by powder rolling as described in copending U.S. patent application No. 546,001, now U.S. Pat. No. 3,947,482. The can was evacuated and sealed. The assembly was then hot isostatically compacted at 1960° F. under an argon gas pressure of about 15,000 pounds per square inch for one hour. The resulting compact was found to be fully dense. After a heat treatment comprising a heating at 2190° F. for ⅓ hour, a furnace cool to 2125° F., an air cool to 1550° F. and a hold at 1550° F. for 16 hours followed by an air cool to room temperature, the stress rupture properties at 1400° F. and 90,000 pounds per square inch were 185 hours with 7% elongation and 9.2% reduction in area. The resulting disc was near final shape, thus illustrating production of a gas turbine rotor disc with minimal machining.

EXAMPLE II

A preform of a Smith & Ridley low alloy steel containing .03% Cr, 4.0% Ni, 3.4% Mo, 0.1% Al, 1.2% Ti, and 0.005% B, was also fabricated and welded into the preform shown in FIG. 1(*a*). The preform was secured between the same two-part mold identified in Example I. The assembly was then placed in the furnace at 1700° F. and heated for 1 hour at a pressure of 50 pounds per square inch of argon, which minimized oxidation on inside surface of container. Subsequently, the preform was inflated using 200 pounds per square inch of argon for one hour. During this time, the can material deformed superplastically; however, it did not conform to the die surfaces as well as did the superplastic alloy described in Example I. Following superplastic forming, the assembly was removed from the furnace, cooled to room temperature maintaining an argon atmosphere inside the container, and removed from the mold. This procedure was duplicated for another Smith & Ridley low alloy steel containing 0.03% C, 4.0% Ni, 3.0% Mo, 0.1% Al, 1.6% Ti, and 0.005% B. Each can was filled with superalloy powder which was consolidated by HIPping as in Example I. Following the HIPping of superalloy powder to full density, the containers of the Smith & Ridley steels were dissolved from the consolidated superalloy shapes by acid leaching using a 50% $HNO_3$ aqeuous solution. The advantage of using the leachable steel is that light machining can be done to prepare the consolidated shapes for sonic testing, and the machining chips will not be contaminated with large amounts of iron which would lower their scrap value.

It will be appreciated that the invention is directed to the hot isostatic pressing of metallic materials requiring a hot isostatic forming temperature in the range of about 1600° to about 2600° F. The superplastic stainless steels, nickel-base alloys and iron-base alloys described hereinbefore are compatible with such forming temperature regimes. It is to be appreciated in this connection that other superplastic alloys are known which have relatively low melting points.

It is to be appreciated that the metal can or container for hot isostatic pressing which is afforded in accordance with the invention provides a neat solution to various problems which face the art in employing the hot isostatic pressing technology. Thus, cans can be made to close dimension thereby facilitating the production of final hot isostatically pressed articles which require minimum machining to final dimension. Furthermore, the cans are capable of being formed into complex cross-sectional shape without difficulty and without the need for multiple die forming. Furthermore the resulting can or container is sturdy and may be handled in production without fear of breakage as may be encountered in connection with ceramic or glass materials employed for the same purpose.

Although the present invention has been described in conjunction with preferred embodiments, it is to be understood that modificatons and variations may be resorted to without departing from the spirit and scope of the invention, as those skilled in the art will readily understand. Such modifications and variations are considered to be within the purview and scope of the invention and appended claims.

I claim:

1. In the process for producing consolidated metal articles by hot pressing metal powders isostatically wherein metal powder to be hot pressed is contained in a metal container and the resulting assembly is subjected to a combination of an elevated temperature and fluid pressure sufficient to hot press said metal powder the improvements comprising forming said metal container by welding together elements of superplastic metal sheet, placing the resulting weldment within a mold having the desired container shape, inflating the weldment within said mold using low internal pressure at the superplastic forming temperature for said superplastic metal while restraining substantial movement of the weld metal, whereby fracture of said weld is avoided, and thereafter introducing metal powder into the container and isostatically hot pressing the metal powder in the welded and inflated superplastic metal container.

2. The process of claim 1 wherein the superplastic metal is selected from the group consisting of a superplastic stainless steel, a superplastic nickel-chromium-iron alloy and a superplastic alloy steel.

3. The process of claim 2 wherein rotational movement of the superplastic material about the centerline of the weld is restrained so as not to exceed 90°.

4. The process of claim 3 wherein said rotational movement does not exceed 45°.

* * * * *